US006767249B1

(12) United States Patent
Li

(10) Patent No.: US 6,767,249 B1
(45) Date of Patent: Jul. 27, 2004

(54) COAXIAL CABLE CONNECTOR

(76) Inventor: Jackie Li, No. 12-1, Lane 159, Sec. 1, Kuo Kuang Rd., Ta Li City, Taichung Hsien (TW)

( * ) Notice: Subject to any disclaimer, the term of this patent is extended or adjusted under 35 U.S.C. 154(b) by 0 days.

(21) Appl. No.: 10/350,264

(22) Filed: Jan. 24, 2003

(51) Int. Cl.[7] ..... H01R 9/05
(52) U.S. Cl. ..... 439/579; 439/585
(58) Field of Search ..... 439/578, 585

(56) References Cited

U.S. PATENT DOCUMENTS 6,241,553 B1 * 6/2001 Hsia ..... 439/578
6,425,782 B1 * 7/2002 Holland ..... 439/585
6,530,807 B2 * 3/2003 Rodrigues et al. ..... 439/578
6,575,785 B2 * 6/2003 Bohmer et al. ..... 439/578

* cited by examiner

*Primary Examiner*—Gary F. Paumen
*Assistant Examiner*—James R. Harvey
(74) *Attorney, Agent, or Firm*—Browdy and Neimark, P.L.L.C.

(57) ABSTRACT

A coaxial cable connector is constructed to include a lock nut, a shell inserted in the lock nut, the shell having a smaller front receiving section and a bigger rear receiving section and an inside annular flange at the rear end of the bigger rear receiving section, an inner jacket inserted into the lock nut and the shell and adapted to receive the center conductor of the coaxial cable, the inner jacket having a rear stop flange stopped at a step inside the lock nut and a wedge-like front flange, and an outer jacket inserted into the shell and adapted to hold down the insulative outer shell and outer conductor of the coaxial cable on the periphery of the inner jacket, the outer jacket having a beveled front section, which is forced radially inwards by the inside annular flange of the shell to stop the coaxial cable from displacement.

5 Claims, 4 Drawing Sheets

COAXIAL CABLE CONNECTOR

BACKGROUND OF THE INVENTION

1. Field of the Invention

The present invention relates generally to a coaxial cable connector and, more specifically, to a simple structure of coaxial cable connector, which squeezes the loaded coaxial cable from both sides, stopping the coaxial cable from displacement.

2. Description of the Related Art

A variety of coaxial cable connectors have been disclosed for use to fix coaxial cables, and have appeared on the market. These conventional designs of coaxial cable connectors have respective advantages and drawbacks.

SUMMARY OF THE INVENTION

It is the main object of the present invention to provide a coaxial cable connector, which holds down the coaxial cable positively in position when installed. It is another object of the present invention to provide a coaxial cable connector, which is easy to install and, inexpensive to manufacture.

To achieve these and other objects of the present invention, the coaxial cable connector comprises a lock nut, the lock nut having an axially extended center through hole, and an inside annular step in one end of the center through hole of the lock nut, the center through hole of the lock nut being threaded and having a smooth outer end tapered and disposed remote from the inside annular step and gradually increased in diameter in direction away from the inside step; a shell shaped like a stepped tube, the shell having a front neck, the neck having an outer diameter approximately equal to the inner diameter of the inside annular step of the lock nut, an outside annular groove extended around the periphery of the neck, an O-ring mounted in the outside annular groove around the periphery of the neck, an axially extended through hole, the axially extended through hole of the shell comprising a front bearing section and a rear receiving section, a wedge-like inside annular flange in a rear end thereof, an inside annular groove disposed in the rear receiving section and extended along the wedge-like inside annular flange, and a sloping inside face extended from one side of the inside annular groove of the shell to the periphery of the rear receiving section; a tubular inner jacket, the tubular inner jacket having a wedge-like front flange at one end thereof, an outwardly radially extended stop flange at an opposite end thereof, and a tubular body connected between the wedge-like front flange and outwardly radially extended stop flange of the inner jacket, the tubular body having a stepped outer diameter; and a tubular outer jacket, the tubular outer jacket having a compressive plug boy, a stop flange at one end of the compressive plug body, an axially extended center through hole extended through the compressive plug body and the stop flange of the tubular outer jacket, a tapered front orifice in one end of the axially extended center through hole of the tubular outer jacket, and a tapered rear orifice in an opposite end of the axially extended center through hole of the tubular outer jacket, the compressive plug body having a beveled front section, a rear bearing section abutted against the stop flange of the tubular outer jacket, an outside annular groove extended around the periphery thereof between the beveled front section and the rear bearing section, and a barbed middle section disposed between the outside annular groove and rear bearing section of the compressive plug body.

DETAILED DESCRIPTION OF THE INVENTION

Figure 1:
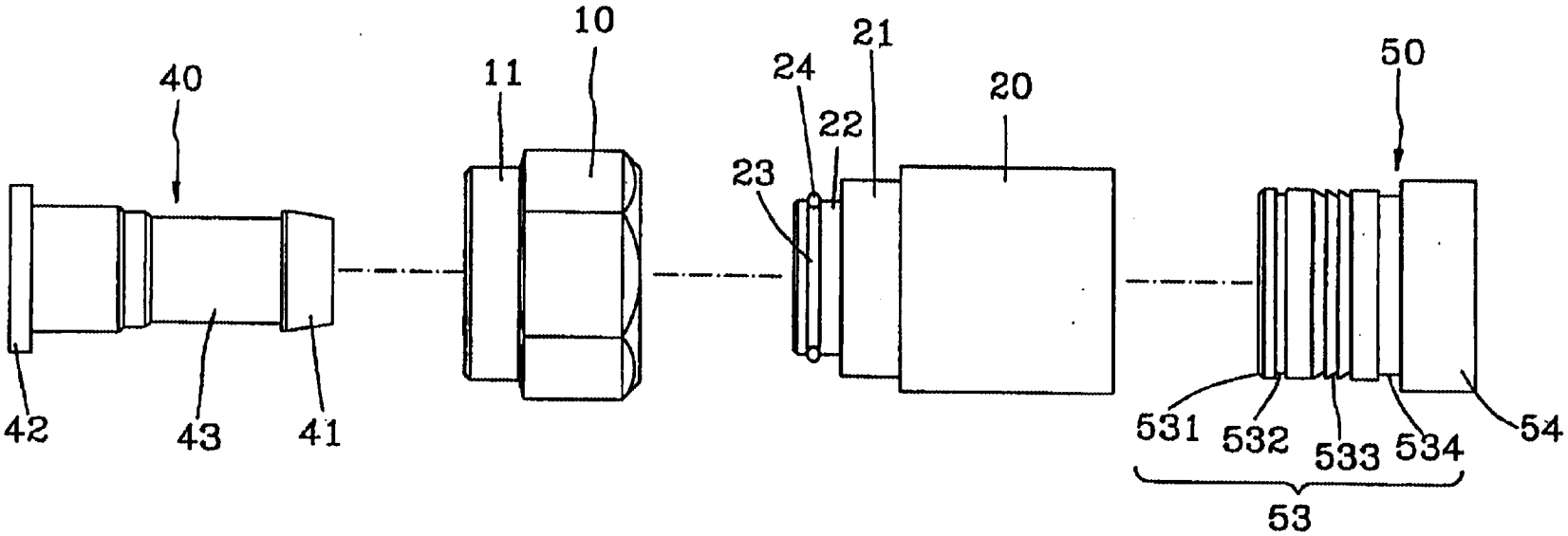
FIG. 1 is an exploded view of a coaxial cable connector according to the present invention.
Figure 2:
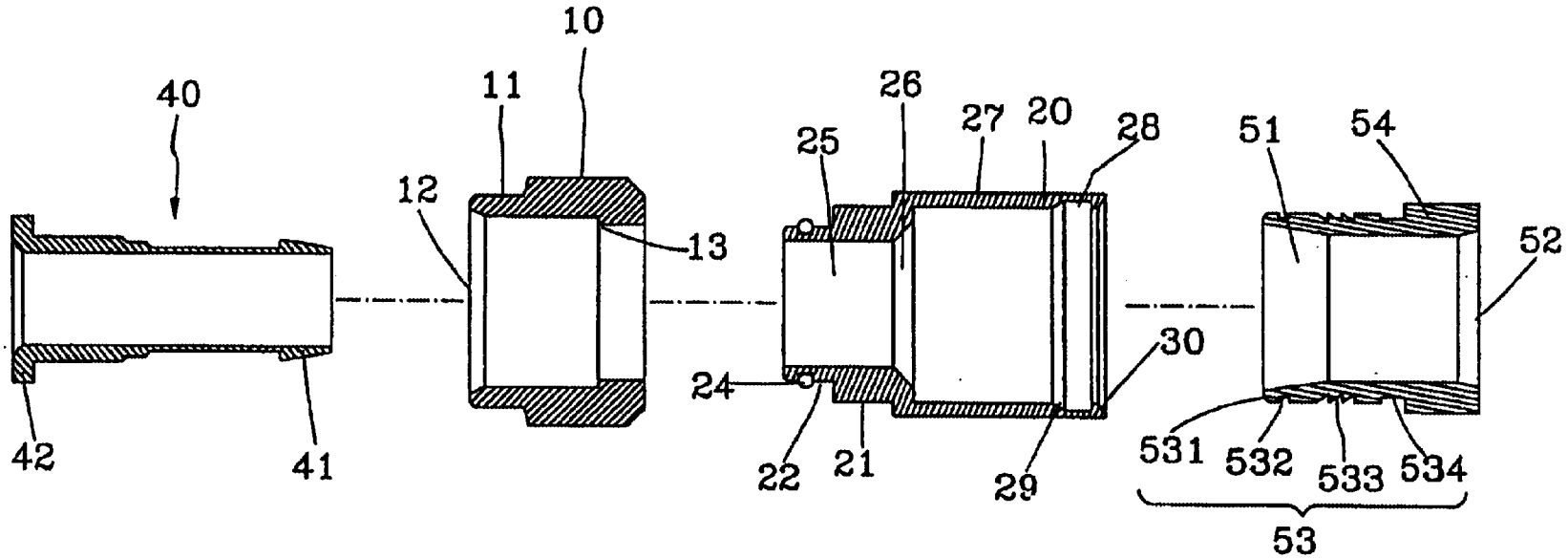
FIG. 2 is an exploded side view in section of FIG. 1.
Figure 3:
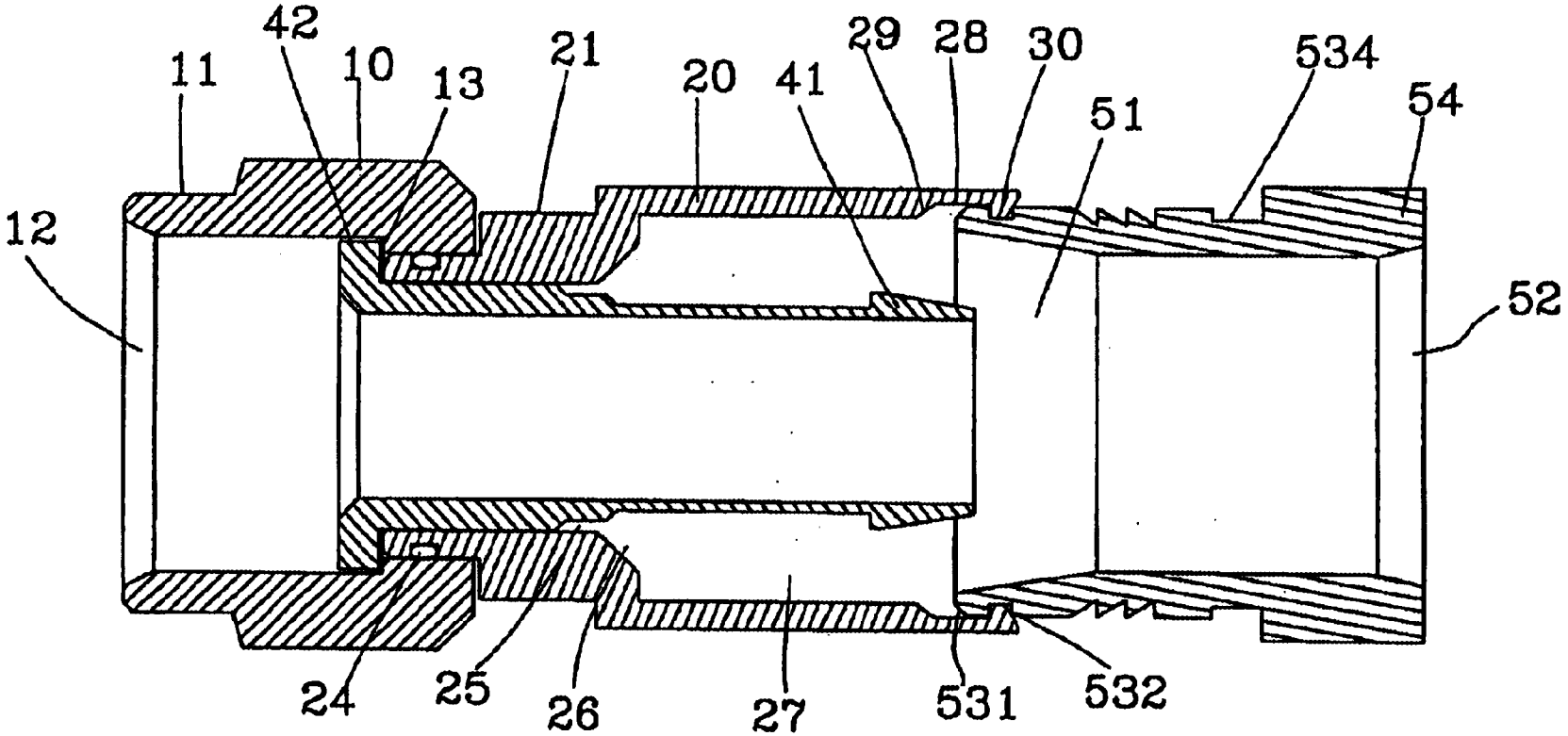
FIG. 3 is a sectional assembly view in an enlarged scale of the coaxial cable connector according to the present invention.

Referring to FIGS. 1~3, a coaxial cable connector is shown comprised of a lock nut 10, a shell 20, an inner jacket 40, and an outer jacket 50.

The lock nut 10 has an axially extended center through hole 12, a shoulder 11 axially extended from one side around the center through hole 12, and an inside annular step 13 extended around the inner diameter at one end remote from the shoulder 11. The center through hole 12 has one end (the end remote from the step) tapered and gradually increased in diameter toward the outside. Further, the middle part of the periphery of the center through hole 12 in front of the inside annular step 13 is threaded.

The shell 20 is shaped like a stepped tube having a shoulder 21 axially forwardly extended from one end, namely, the front end, a neck 22 axially forwardly extended from the shoulder 21, an outside annular groove 23 extended around the periphery of the neck 22, an O-ring 24 mounted in the outside annular groove 23 around the periphery of the neck 22, an axially extended through hole formed of a front bearing section 25, a rear receiving section 27, and a middle expansion section 26 between the front bearing section 25 and the rear receiving section 27, a wedge-like inside annular flange 30 in the other end, namely, the rear end, an inside annular groove 28 in the rear receiving section 27 and extended along the wedge-like inside annular flange 30, and a sloping inside face 29 extended from one side of the inside annular groove 28 to the periphery of the rear receiving section 27. The outer diameter of the neck 23 is approximately equal to the inner diameter of the inside annular step 13 of the lock nut 10.

The inner jacket 40 is a tubular member having a wedge-like front flange 41 at one end, an outwardly radially extended stop flange 42 at the other end, and a tubular body 43 connected between the wedge-like front flange 41 and the outwardly radially extended stop flange 42. The tubular body 43 has a stepped outer diameter formed of three sections arranged in proper order from the smallest to the largest in direction from the wedge-like front flange 41 toward the outwardly radially extended stop flange 42.

The outer jacket 50 is a tubular member having a compressive plug boy 53, a stop flange 54 at one end of the compressive plug body 53, a tapered front orifice 51 in one end of the axially extended center through hole thereof, and a tapered rear orifice 52 in the other end of the axially extended center through hole. The diameters of the tapered front orifice 51 and the tapered rear orifice 52 are gradually increased in reversed directions toward the outside of the outer jacket 50. The tapered front orifice 51 is relatively longer than the tapered rear orifice 52. The compressive plug body 53 has a beveled front section 531, a rear bearing section 534 abutted against the stop flange 54, an outside annular groove 532 extended around the periphery between the beveled front section 531 and the rear bearing section 534, and a barbed middle section 533 disposed between the outside annular groove 532 and the rear bearing section 534.

The coaxial cable connector is assembled by: inserting the neck 22 of the shell 20 into the center through hole 12 of the lock nut 10, and then inserting the inner jacket 40 into the center through hole 12 of the lock nut 10 to let the tubular body 43 of the inner jacket 40 be received inside the shell 20 and the stop flange 42 be stopped at the inside annular step 13, and then inserting the plug body 53 of the outer jacket 50 over the inside annular flange 30 into the inside of the shell 20 to force the inside annular flange 30 of the shell 20 into engagement with the outside annular groove 532 of the outer jacket 50 (see FIG. 3).

Figure 4:
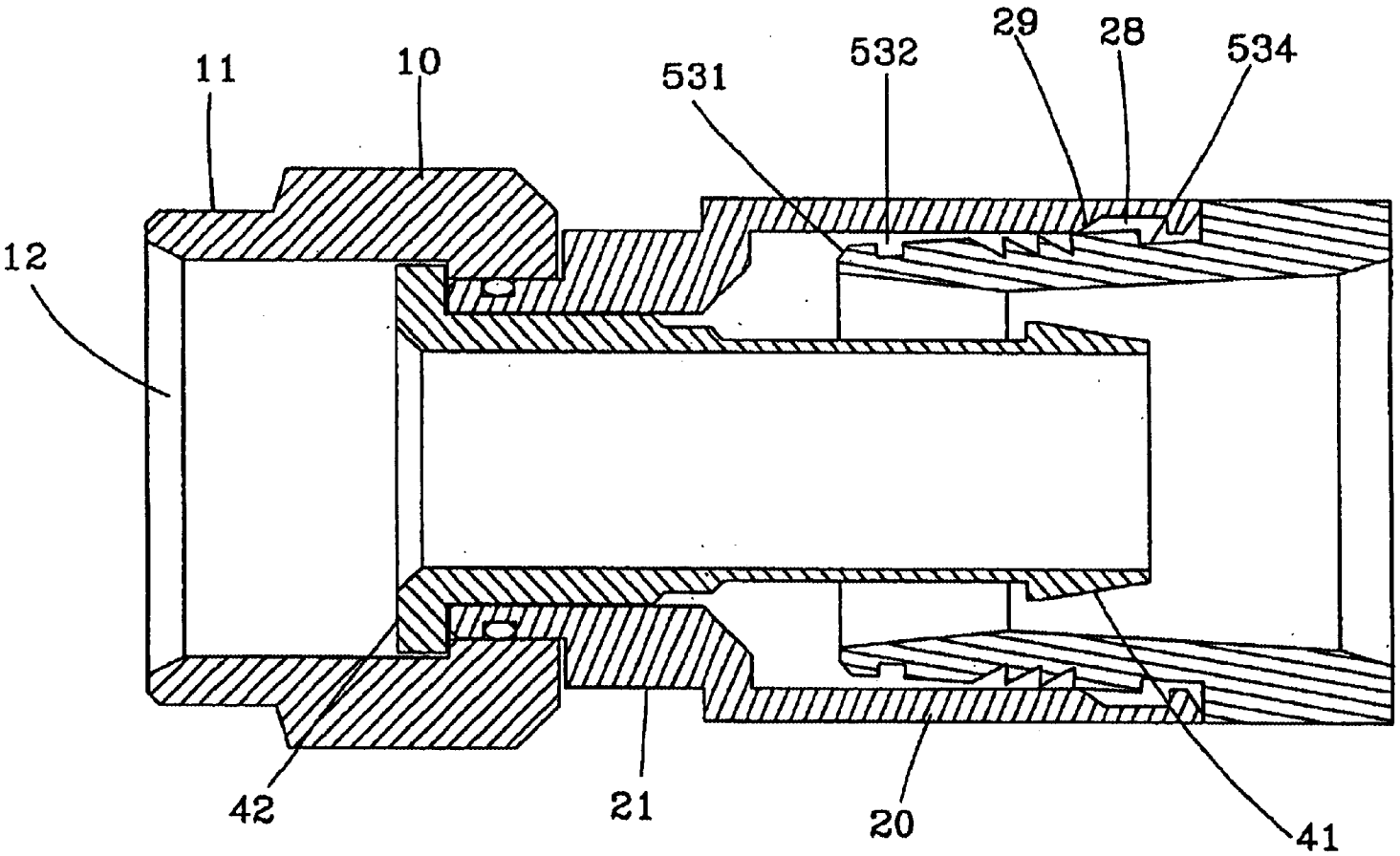
FIG. 4 is similar to FIG. 3 but showing the outer jacket forced inwards and the stop flange of the outer jacket stopped at the rear end of the shell.

Referring to FIG. 4 and FIG. 3 again, during installation, the coaxial cable is inserted into the tapered rear orifice 52 of the outer jacket 50 and pushed forwards into the rear receiving section 27 of the shell 20, for enabling the center conductor of the coaxial cable to be plugged into the inside of the inner jacket 40, and then the outer jacket 50 is forced forwards. When the beveled front section 531 of the plug body 53 of the outer jacket 50 inserted into the shell 20, the sloping face 29 guides the beveled front section 531 of the plug body 53 radially inwards, thereby causing the plug body 53 to be radially inwardly compressed against the periphery of the inner jacket 40 to hold down the insulative shell and outer conductor of the coaxial cable in between the inner jacket 40 and the outer jacket 50. When the outer jacket 50 set into position, the stop flange 54 is stopped against the rear end of the shell 20. Because the inner end of the tapered front orifice 51 of the outer jacket 50 is disposed relatively closer to the lock nut 10 than the wedge-like front flange 41 of the inner jacket 40, a barbed structure is formed within the outer jacket 50 between the inner end of the tapered front orifice 51 of the outer jacket 50 and the wedge-like front flange 41 of the inner jacket 40 to prohibit the coaxial cable from moving backwards.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A coaxial cable connector comprising:

a lock nut, said lock nut having an axially extended center through hole, and an inside annular step in one end of the center through hole of said lock nut, the center through hole of said lock nut being threaded and having a smooth outer end tapered and disposed remote from said inside annular step and gradually increased in diameter in direction away from said inside step;

a shell shaped like a stepped tube, said shell having a front neck, said neck having an outer diameter approximately equal to the inner diameter of said inside annular step of said lock nut, an outside annular groove extended around the periphery of said neck, an O-ring mounted in the outside annular groove around the periphery of said neck, an axially extended through hole, the axially extended through hole of said shell comprising a front bearing section and a rear receiving section, a wedge-like inside annular flange in a rear end thereof, an inside annular groove disposed in said rear receiving section and extended along said wedge-like inside annular flange, and a sloping inside face extended from one side of the inside annular groove of said shell to the periphery of said rear receiving section;

a tubular inner jacket, said tubular inner jacket having a wedge-like front flange at one end thereof, an outwardly radially extended stop flange at an opposite end thereof, and a tubular, body connected between the wedge-like front flange and outwardly radially extended stop flange of said inner jacket, said tubular body having a stepped outer diameter; and a tubular outer jacket, said tubular outer jacket having a compressive plug boy, a stop flange at one end of said compressive plug body, an axially extended center through hole extended through the compressive plug body and the stop flange of said tubular outer jacket, a tapered front orifice in one end of the axially extended center through hole of said tubular outer jacket, and a tapered rear orifice in an opposite end of the axially extended center through hole of said tubular outer jacket, said compressive plug body having a beveled front section, a rear bearing section abutted against the stop flange of said tubular outer jacket, an outside annular groove extended around the periphery thereof between said beveled front section and said rear bearing section, and a barbed middle section disposed between the outside annular groove and rear bearing section of said compressive plug body.

2. The coaxial cable connector as claimed in claim 1, wherein said shell has a front shoulder axially forwardly extended from a front end thereof, and the neck of said shell is axially forwardly extended from the shoulder of said shell.

3. The coaxial cable connector as claimed in claim 1, wherein the axially extended through hole of said tubular shell further comprises a middle expansion section connected between said front bearing section and said rear receiving section.

4. The coaxial cable connector as claimed in claim 1, wherein said lock nut further comprises a shoulder extended from one side thereof around one end of the center through hole of said lock nut.

5. The coaxial cable connector as claimed in claim 1, wherein the stepped outer diameter of said inner jacket is formed of three sections arranged in proper order from the smallest to the largest in direction from the wedge-like front flange of said inner jacket toward the outwardly radially extended stop flange of said inner jacket.

* * * * *